US005078582A

United States Patent [19]

Ohbayashi et al.

[11] Patent Number: 5,078,582

[45] Date of Patent: Jan. 7, 1992

[54] RECIPROCATORY PISTON TYPE COMPRESSOR HAVING A NOISE AND VIBRATION SUPPRESSED DISCHARGE VALVE MECHANISM

[75] Inventors: Masakazu Ohbayashi; Hayato Ikeda; Satoshi Umemura; Hisato Kawamura, all of Kariya, Japan

[73] Assignee: Kabushiki Kaisha Toyoda Jidoshokki Seisakusho, Kariya, Japan

[21] Appl. No.: 636,772

[22] Filed: Jan. 2, 1991

[30] Foreign Application Priority Data

Jan. 16, 1990 [JP] Japan ..... 2-2581[U]
Oct. 25, 1990 [JP] Japan ..... 2-288654

[51] Int. Cl.[5] ..... F04B 21/02
[52] U.S. Cl. ..... 417/571; 137/512.15
[58] Field of Search ..... 137/855, 856, 857, 858, 137/512.15; 417/570, 571

[56] References Cited

U.S. PATENT DOCUMENTS 2,151,746 3/1939 Cody ..... 137/856
4,911,614 3/1990 Kawai et al. ..... 137/856
4,976,284 12/1990 Hovarter ..... 137/856

*Primary Examiner*—Richard A. Bertsch
*Assistant Examiner*—Charles Freay
*Attorney, Agent, or Firm*—Brooks Haidt Haffner & Delahunty

[57] ABSTRACT

A valve plate accommodated in a reciprocatory piston type compressor and arranged between an axial end of a cylinder block provided with a plurality of cylinder bores in which a plurality of double-headed pistons are reciprocated to compress a refrigerant gas, and a housing member provided with a suction chamber and a discharge chamber. The valve plate is provided with a plurality of suction ports communicating between the suction chamber and the plurality of cylinder bores and openably closed by suction valves, and a plurality of discharge ports communicating between the discharge chamber and the plurality of cylinder bores of the cylinder block. The valve plate is provided with surface portions extended around each of the discharge ports to be cooperable with the spring steel discharge valves for opening and closing the discharge ports, and formed to have 10 through 20 Rz surface roughness and a Vicker's hardness of 120 through 450.

7 Claims, 6 Drawing Sheets

RECIPROCATORY PISTON TYPE COMPRESSOR HAVING A NOISE AND VIBRATION SUPPRESSED DISCHARGE VALVE MECHANISM

BACKGROUND OF THE INVENTION

1. Field of the Invention

The present invention relates to a reciprocatory piston type compressor for compressing a refrigerant gas, and more particularly, to a reciprocatory piston type compressor having a noise and vibration suppressed discharge valve mechanism.

2. Description of the Related Art

Many reciprocatory piston type compressors, such as a swash plate type compressor and a wobble plate type compressor are known. A typical swash plate type compressor having a reciprocatory piston-operated compressing mechanism for compressing a refrigerant gas is shown in FIG. 9. The compressor of FIG. 9 has a pair of axially combined cylinder blocks 1 and 2 which are closed at front and rear opposite ends thereof by a front and rear housings 5 and 6, via front and rear valve plates 3 and 4, respectively. The front housing 5, the front valve plate 3, the cylinder blocks 1 and 2, the rear rear valve plate 4, and the rear housing 6 are tightly combined together by a suitable number of screw bolts ( not shown ). The combined cylinder blocks 1 and 2 have a swash plate chamber 7 formed therein at a connecting portion thereof, and a swash plate 9 is arranged in the swash plate chamber 7 to be keyed on a drive shaft 8 extended through shaft bores 1*a* and 2*a* formed at the center of the combined cylinder blocks 1 and 2. The combined cylinder blocks 1 and 2 are provided with a plurality of axial cylinder bores 10 radially equidistantly arranged around the axis of the drive shaft 8 and axially extended in parallel with the center of the drive shaft 8. A plurality of double-headed pistons 11 are slidably fitted in the plurality of cylinder bores 10 to be engaged with the swash plate 9 via shoes 12, and are reciprocated by the swash plate 9 when the swash plate 9 is rotated together with the drive shaft 8.

The front and rear housings 5 and 6 are provided with outer suction chambers 13 and 14 for a refrigerant gas before compression, respectively, and inner discharge chambers 15 and 16 for the refrigerant gas after compression, respectively. The swash plate chamber 7 is fluidly connected to the suction chambers 13 and 14 via a suction passageway ( not shown ), and the discharge chambers 15 and 16 are fluidly connected to an external refrigerating circuit.

The front and rear valve plates 3 and 4 are provided with suction ports 17 and 18 fluidly connecting the suction chambers 13 and 14 to the cylinder bores 10, and discharge ports 19 and 20 fluidly connecting the cylinder bores 10 to the discharge chambers 15 and 16. The front and rear valve plates 3 are also provided with inner faces, respectively, confronting the cylinder bores 10 of the combined cylinder blocks 1 and 2, and covered with front and rear suction valve sheets having suction valves 21 and 22 which open and close the suction ports 17 and 18. The valve plates 3 and 4 are further provided with outer faces, respectively, confronting the front and rear housings 5 and 6, and covered with front and rear valve sheets having discharge valves 23 and 24 which open and close the discharge ports 19 and 20. Valve retainers 25 and 26 are arranged behind the discharge valves 23 and 24, respectively, to limit the opening of the discharge valves 23 and 24.

The front and rear discharge valves 23 and 24 are formed in such a manner that they are in close contact with marginal portions of the outer faces of the valve plates 3 and 4, surrounding the discharge ports 19 and 20, and therefore, when the pressure of the refrigerant gas in the cylinder bores 10 rises to a predetermined level due to compression by the reciprocating pistons 11, the discharge valves 23 and 24 are bent toward the respective valve retainers 25 and 26 to open the discharge ports 19 and 20 and thereby permit the refrigerant gas compressed in the cylinder bores 10 to be discharged toward the discharge chambers 15 and 16.

The above-described reciprocatory piston type compressor is supplied with a lubricating oil in the form of an oil mist suspended in the refrigerant gas, and thus, the oil mist is adhered to the end surfaces of the front and rear valve plates 3 and 4 and the surfaces of the front and rear discharge valves 23 and 24 in a manner such that the end surfaces of the front and rear valve plates 3 and 4, and the surfaces of the front and rear discharge valves 23 and 24, are always coated with an oil film. The end faces of the front and rear valve plates 3 and 4 also are provided with smooth surfaces having surface roughness between only 6 through 7 Rz so that, when the valve plates 3 and 4 are accommodated in the compressor between the axial ends of the cylinder blocks 1 and 2 and the front and rear housings 5 and 6, a complete air-tight condition between the high pressure region, e.g., the discharge chambers 15 and 16 and the low pressure region, e.g., the suction chambers 13 and 14, is achieved without an occurrence of a fluid leakage via the surfaces of the valve plates 3 and 4, to thereby obtain a high volumetric efficiency in the compression of the refrigerant gas. Namely, if the surface of the end faces of the valve plates 3 and 4 is rough, an oozing of the high pressure refrigerant gas from the high pressure region to the low pressure region via the rough end faces of the valve plates 3 and 4 occurs, due to a pressure differential between the high and low pressure sides, and therefore, the volumetric efficiency in the compression of the refrigerant gas is lowered.

Nevertheless, when the surface of the end faces of the valve plates 3 and 4 are smooth, the discharge valves 23 and 24 of the valve sheets are brought into tight contact with the end face of the valve plates 3 and 4 during the closing of the discharge ports 19 and 20, due to a surface tension exhibited by the oil film coating the valve plates 3 and 4. Accordingly, during the operation of the compressor the discharge valves 23 and 24 of the valve sheets are not separated from the end faces of the valve plates 3 and 4, to open the discharge ports 19 and 20, until the refrigerant pressure in the cylinder bores 10 rises to a pressure level sufficient to overcome the surface tension and the adhesive force of the oil film, and therefore, an excessive compression occurs in each of the cylinder bores 10. Thus, when the discharge valves 23 and 24 are opened under such an excessive compression of the refrigerant gas in the cylinder bores 10, the compressed gas bursts out of the cylinder bores 10 into the discharge chambers 15 and 16, and the ends of the opened discharge valves 23 and 24 violently collide with the valve retainers 25 and 26. Therefore, the compressor and the surrounding mechanisms generate an undesirable pulsive vibration and noise.

To overcome the above-mentioned vibration and noise problems encountered by the conventional reciprocatory piston type compressor, the present assignee company has already made several proposals. For example, U.S. Pat. No. 4,781,540 to Ikeda et al discloses an asymmetric valve mechanism for a piston type compressor. Nevertheless, the present inventors have continued their experiments, to obtain a less costly method of solving the above-mentioned problems, and accordingly, experimented with a roughening of the end faces of the valve plates at particular portions surrounding each of the discharge ports and coming into contact with the discharge valves, to prevent the above-mentioned tight contact between the discharge valves and the valve plates. As a result, the occurrence of an excessive compression of the refrigerant gas in the cylinder bores could be reduced, and therefore, the noise and vibration were suppressed. Nevertheless, it was found that, when the discharge valves 23 and 24 repeatedly collide against the valve plates to close the discharge ports of the valve plates 3 and 4, the roughened portions of the end faces of the valve plates 3 and 4 are gradually abraded and become smooth, and accordingly, the excessive compression of the refrigerant gas in the cylinder bores 10 gradually reoccurs. Namely, it is difficult to prevent the occurrence of the excessive compression of the refrigerant gas in the cylinder bores 10 after a long time usage of the compressor.

SUMMARY OF THE INVENTION

Therefore, an object of the present invention is to provide a reciprocatory piston type compressor provided with a discharge valve mechanism capable of reducing noise and vibration caused by an excessive compression of the refrigerant gas for a long time.

Another object of the present invention is to provide a discharge valve mechanism for a reciprocatory piston type compressor, capable of reducing noise and vibration by a lower cost manufacturing method.

In accordance with the present invention, there is provided a reciprocatory piston type compressor which comprises:

a cylinder block having a plurality of axial cylinder bores formed therein as compressing chambers for permitting pistons therein to be reciprocated to compress a refrigerant gas;

at least a housing closing an axial end of the cylinder block for forming a suction chamber receiving therein a refrigerant gas to be compressed and a discharge chamber for receiving a compressed refrigerant gas;

a valve plate arranged between the axial end of the cylinder block and the housing, and having a first end face confronting the axial end of the cylinder block, an opposite second end face confronting the housing, a plurality of suction ports for fluidly communicating between the suction chamber of the housing and the compression chambers, and a plurality of discharge ports for fluidly communicating between the compression chambers and the discharge chambers of the housing;

a suction valve means arranged to be in close contact with the first end face of the valve plate, and having a plurality of suction valves closably opening the suction ports of the valve plate in response to a reciprocating motion of the pistons; and a discharge valve means arranged to be in close contact with the second face of the valve plate, and having a plurality of discharge valves closably opening the discharge ports of the valve plate in response to a reciprocating motion of the pistons, wherein said second end face of said valve plate has a plurality of surface portions extended around each of said plurality of discharge ports, and formed to have a predetermined surface roughness, each of said surface portions being subjected to a hardening treatment to a Vicker's hardness of 120 through 450.

In accordance with the above-mentioned reciprocatory piston type compressor, when a pressure level in the cylinder bores is increased due to the compression of the refrigerant gas by the reciprocation of the pistons during the closing of the discharge valves, the compressed refrigerant gas oozing from the cylinder bores enters the roughened portions of the second end face of the valve plate to remove a lubricating oil from between the valve plate and the discharge valves, and accordingly, the surface tension of the lubricating oil is lowered to thereby loosen the tight contact between the second end face of the valve plate and the discharge valves. Further, the above-mentioned compressed refrigerant gas entering the roughened portions of the second end face of the valve plate lowers a pressure acting on the discharge valves from the side of the discharge chamber, and therefore, the discharge valves become easier to open. Therefore, when the pressure in the cylinder bores reaches a predetermined level due to the compression of the refrigerant gas, the discharge valves are readily opened. Accordingly, an occurrence of an excessive compression of the refrigerant gas in the cylinder bores can be prevented, to thereby suppress noise and vibration of the discharged refrigerant gas.

When the discharge valves return to the position closing the discharge ports of the valve plate, the discharge valves collide with the end faces of the valve plate. Nevertheless, since the roughened portions of the second end face of the valve plate surrounding respective discharge ports are hardened to a Vicker's hardness of 120 through 450, the roughened portions of the valve plate are not easily abraded, and accordingly, the noise and vibration reduction effect can be maintained for a long time.

BRIEF DESCRIPTION OF THE DRAWINGS

The above and other objects, features, and advantages of the present invention will be made more apparent from the ensuing description of the embodiment in conjunction with the accompanying drawings wherein.

DESCRIPTION OF THE PREFERRED EMBODIMENTS

Figure 1:
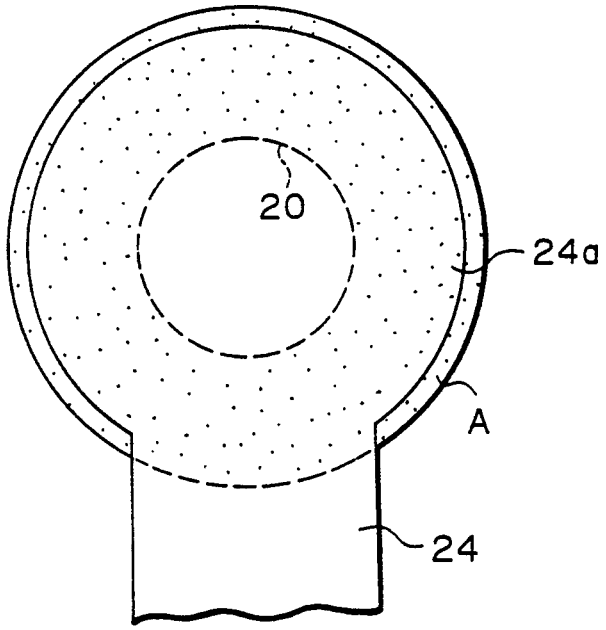
FIG. 1 is a partial enlarged front view of a surface-roughened portion of a valve plate and a cooperating discharge valve, according to the present invention.

The description of a discharge valve mechanism for a reciprocatory piston type compressor embodying the present invention will be given hereinafter with reference to the illustrations of FIGS. 1 through 8. It should be noted that, since the construction of the reciprocatory piston type compressor embodying the present invention is the same as that of the prior art, except for the construction of the valve plate, the same reference numerals as those used in FIG. 9 will be used to designate corresponding elements and parts of the compressor according to the present invention. It should be further noted that, since the front and rear sides of the compressor exhibit substantially the same operation, the discharge valve mechanism on the rear side of the compressor will be exemplified hereinafter.

Figure 2:
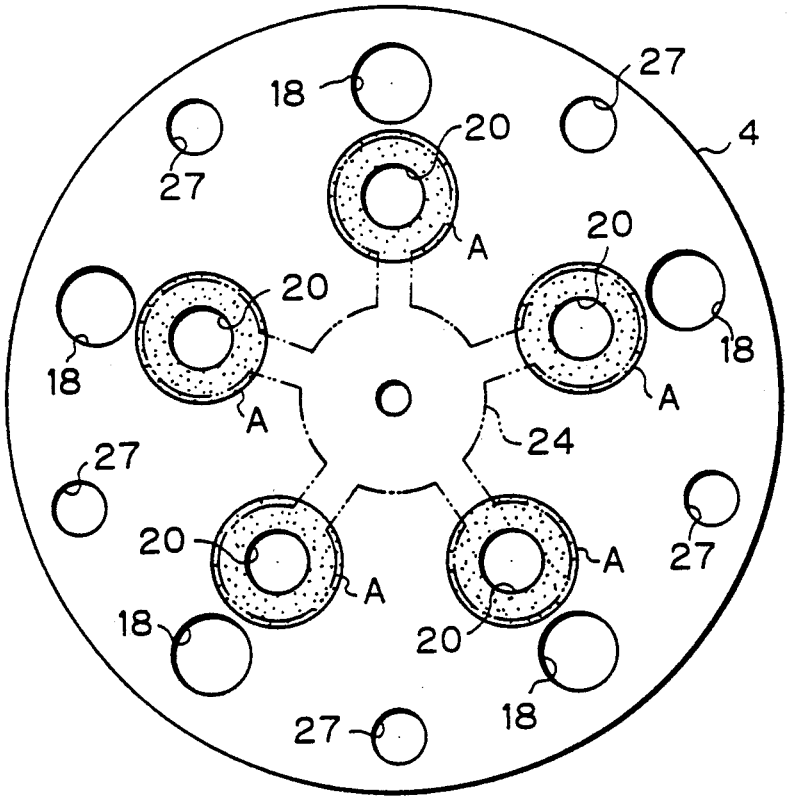
FIG. 2 is a front view of a valve plate having a plurality of discharge ports and a valve sheet having the corresponding number of discharge valves, according to the present invention.

A valve plate 4 to be accommodated in the reciprocatory piston type compressor is made of iron, and is provided with a first flat face 4*a* confronting the cylinder block 2 ( FIG. 9 ), a second flat face 4*b* confronting the housing 6 ( FIG. 9 ), and a plurality of ( five in the present embodiment ) suction and discharge ports 18 and 20 formed therein. As shown in FIG. 2, the valve plate 4 is also provided with a plurality of through-holes 27, each arranged between two neighbouring suction ports 18 and permitting screw bolts ( not shown ) to pass therethrough to thereby axially combine the cylinder blocks 1 and 2, and the front and rear housings 5 and 6.

The valve plate 4 has portions designated by "A" in the second face 4*b*, and each portion "A" of the valve plate 4 surrounds one of the discharge ports 20 as illustrated in FIG. 1 and has a surface area slightly larger than that of a front end portion 24*a* of a discharge valve 24 operating to openably close the discharge port 20. Each portion "A" of the valve plate 4 is subjected to a roughening treatment to a more than 10 through 20 Rz surface roughness. The remaining portion of the second surface 4*b* of the valve plate 4 is formed to have an approximately 6 through 7 Rz surface roughness, similar to the valve plate of the prior art. The surface-roughened portions "A" of the valve plate 4 are subjected to a surface hardening treatment, to a 120 through 450 Vicker's hardness ( Hv ). Namely, to obtain a desired surface hardness, the valve plate 4 is either made of e.g., a carbon steel which can be hardened by quenching, such as S45C steel according to the Japanese Industrial Standard ( JIS G 3102 ), or a different type of steel material obtained by hardening, e.g., a hot rolled steel plate by increasing an amount of carbon and a manganese component contained therein.

Figure 3A:
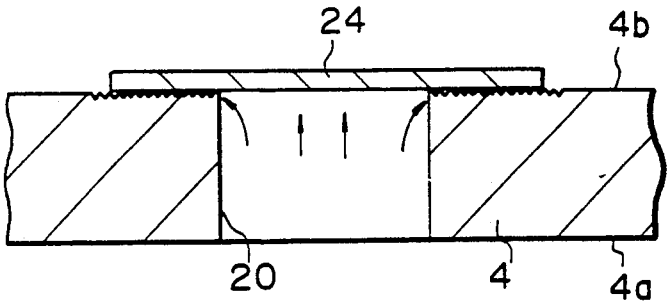
FIGS. 3A and 3B are partial enlarged cross-sectional views of the valve plate and the discharge valve according to the present invention, illustrating the two different operating conditions thereof.
Figure 3B:
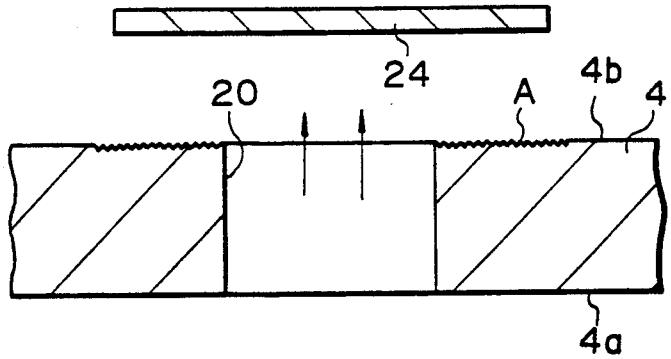

Referring to FIG. 3, when the discharge valve 24 closes the discharge port 20 of the valve plate 4, the discharge valve 24 is in substantially close contact with the portion "A" surrounding the discharge port 20. Subsequently, when the compression of a refrigerant gas by the piston 11 causes a rise in a pressure level in the cylinder bore 10 to approach a level sufficient for opening the discharge port 20 by lifting the discharge valve 24, the compressed refrigerant gas forcibly enters between the roughened portion "A" of the valve plate 4 and the discharge valve 24 while removing a lubricating oil from between the valve plate 4 and the discharge valve 24, and accordingly, the strong contact between the discharge valve 24 and the face 4*b* of the valve plate 4 by a surface tension of the lubricating oil is weakened. Also, a differential between forces acting on the discharge valve 24 from both sides thereof, i.e., from the side of the discharge chamber 16 and from the side of the cylinder bore 10, is reduced. Accordingly, the discharge valve 24 becomes ready for being lifted to open the discharge port 20. Therefore, as soon as the pressure in the cylinder bore 10 rises to a level sufficient for moving the discharge valve 24 away from the face 4*b* of the valve plate 4, the discharge port 20 of the valve plate 4 is immediately opened. Namely, the discharge valve 24 is moved from the closing to opening positions thereof at a desired timing under a predetermined pressure level prevailing in the cylinder bore 10. Therefore, the discharge valve 24 can be prevented from causing a strong collision with the valve retainer 26 located in the discharge chamber 16, and accordingly, a generation of noise is suppressed. In addition, since the refrigerant gas is not excessively compressed, a generation of vibration and noise due to a bursting of the compressed refrigerant gas out of the cylinder bore 10 is prevented, and a pulsation of the discharge pressure of the compressed refrigerant gas is sufficiently lessened.

Figure 4A:
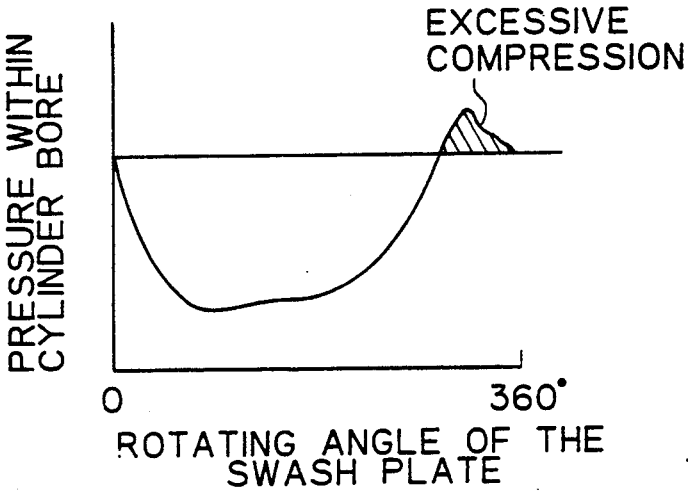
Fig. 4A (PRIOR ART)
FIG. 4A is a graphical view, illustrating the relationship between an angle of rotation of a swash plate and a pressure level in cylinder bores in the case wherein the conventional valve plate is accommodated in a reciprocatory piston type compressor according to the prior art.
Figure 4B:
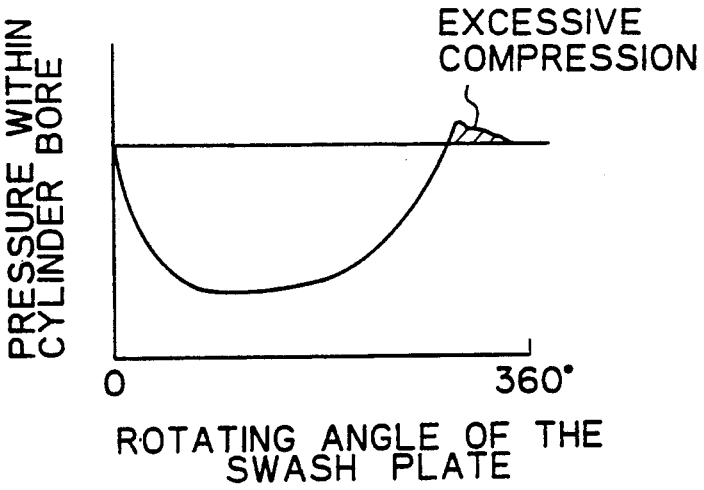
FIG. 4B is a graphical view, illustrating the relationship between an angle of rotation of a swash plate and a pressure level in cylinder bores of the reciprocating piston type compressor provided with the discharge valve mechanism according to the present invention.

FIGS. 4A and 4B illustrate results of measurement of a change in the pressure within the cylinder bore 10 during one complete rotation of the swash plate 9 (FIG. 9) when the compressors provided with the valve plates 3 and 4 according to the present invention and the prior art, respectively were operated under the running condition set forth below.

The number of rotation of the compressors: 1,000 R.P.M

The suction pressure of the refrigerant gas: 2 $Kg/cm^2$

The discharge pressure of the refrigerant gas: 15 $Kg/cm^2$

From the comparison between the illustrations of FIGS. 4A and 4B, it is confirmed that an excessive pressure occurring in the compressor provided with the valve plates according to the present invention is less than that occurring in the compressor provided with the valve plates according to the prior art. From these results, it is understood that, in accordance with the present invention, a noise and vibration suppression and a reduction in the pulsation of the discharge pressure are achieved.

Nevertheless, when the surface roughness of the portions "A" of the valve plate 4 surrounding the discharge port 20 is extreme, a leakage of the compressed refrigerant gas occurs even during the closing position of the discharge valve 24, and accordingly, the volumetric efficiency in the compression of the refrigerant gas by the compressor will be reduced. Consequently, the operating efficiency of the reciprocatory piston type compressor is lessened. Namely, the surface roughness of the portions "A" of the valve plates 3 and 4 must not be excessively roughened.

Figure 5:
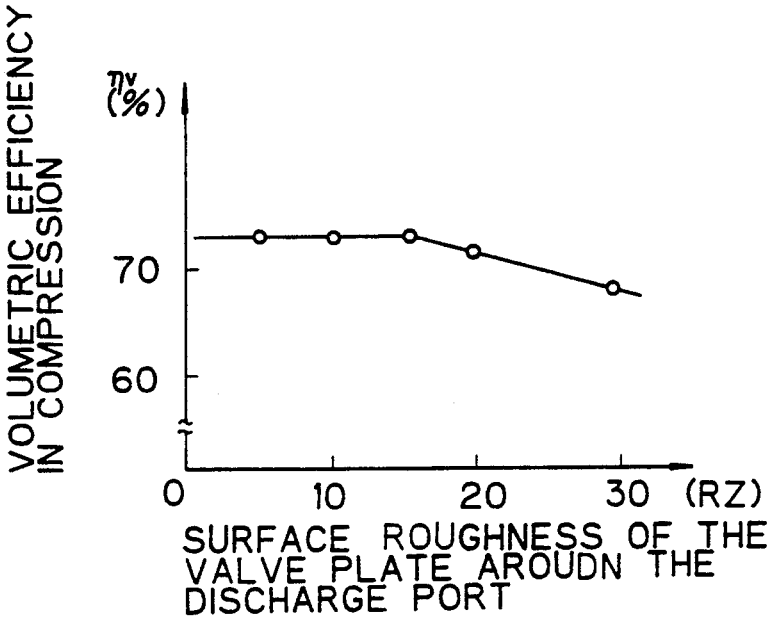
FIG. 5 is a graphical view, illustrating the relationship between the surface roughness of a valve plate accommodated in a reciprocating piston type compressor and the volumetric efficiency exhibited by the compressor.

FIG. 5 illustrates a result of experiments conducted to measure a change in the volumetric efficiency in the compression of the refrigerant gas with respect to various surface roughnesses of the portions "A" surrounding the discharge ports 20. From the illustration of FIG. 5, it is understood that, although the volumetric efficiency is maintained approximately constant with a change in the surface roughness of the valve plates from 0 through 20 Rz, the volumetric efficiency is lowered with an increase in the surface roughness of the valve plate 4 to more than 20 Rz.

Figure 6:
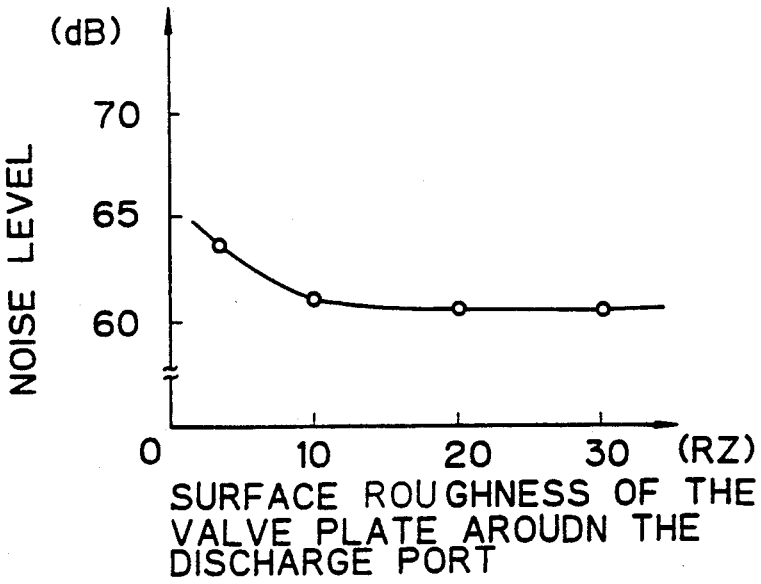
FIG. 6 is a graphical view, illustrating the relationship between the surface roughness of a valve plate accommodated in a reciprocating piston type compressor and the noise level.

Also, an experiment was conducted to measure a change in the noise level with a change in the surface roughness of the portions "A" of the valve plate 4 FIG. 6 illustrates the result of the above-mentioned experiment.

It can be seen from the illustration of FIG. 6 that, when the surface roughness of the portions "A" of the valve plate 4 is increased to more than 10 Rz, the noise level is reduced by approximately 3 dB, and that the noise levels at 20 and 30 Rz surface roughnesses are substantially the same. Therefore, it can be understood that a preferable surface roughness of the portions "A" of the valve plate 4 is approximately 10 through 20 Rz. It was, however, confirmed from an conducted experiment that, when the entire end face **4*b* of the valve plate 4 was roughened to a 10 through 20 Rz surface roughness, the sealing characteristic between the valve plate 4 and the gasket, i.e., the valve sheet, was deteriorated to cause a leakage of the compressed refrigerant at various portions of the compressor. Thus the entire face 4*b* of the valve plate 4** should not be roughened.

Figure 7:
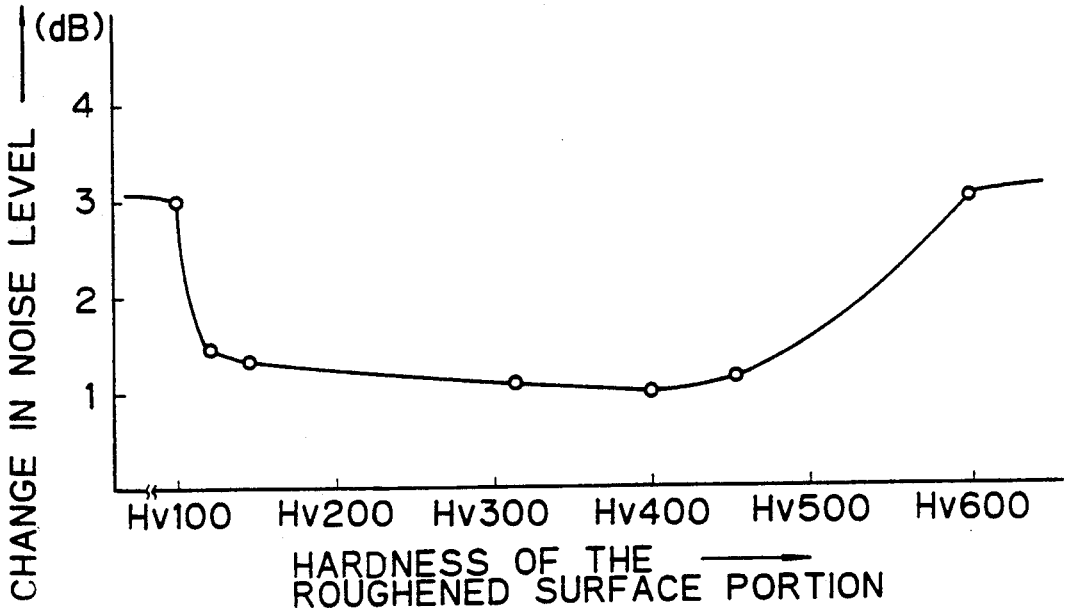
FIG. 7 is graphical view, illustrating the relationship between the hardness of the surface-roughened portion of a valve plate accommodated in a reciprocating piston type compressor and a change in a noise level.

FIG. 7 illustrates a result of an experiment wherein a change in the noise level with a change in the surface hardness of the roughened portions "A" of the valve plate 4 was measured. In FIG. 7, the change in the noise level on the ordinate indicates a difference between the noise levels measured at times before and after the continuous operation of the compressor for a long time ( in the conducted experiment, a continuous operation for 100 hours ). When conducting the experiment, the valve plates 4 provided with the roughened portions "A" having a Vicker's hardness ( Hv ) of 300 or more, were obtained by subjecting these plates 4 to a hardening treatment using the quenching method, and the valve plates 4 provided with the roughened portions "A" having a Vicker's hardness of 120 and 150 were obtained by making these valve plates of the afore-mentioned hot rolled steel plate after adjusting the amounts of the carbon and manganese components.

It is understood from FIG. 7 that, although when a valve plate 4 having a Vicker's hardness of less than 100 was used, the change in the noise level was 3 dB, the change in the noise level could be lessened to 1 dB by using a valve plate 4 having a Vicker's hardness of 120 through 450. When the hardness of the roughened portions "A" of the valve plate 4 is, however, increased beyond a Vicker's hardness of 450, it was understood that the discharge valves 24 made of generally a spring steel having a Vicker's hardness of 510 through 570 were gradually abraded due to repeated contact between the roughened and hardened portions "A" of the valve plate 4, and accordingly, the contacting area of the discharge valves 24 was gradually increased to generate an unfavorable adhering condition between the discharge valves 24 and the valve plate 4. Thus, the discharge valves 24 could not be adequately opened, and large noise was generated. Consequently, it was confirmed that a desirable hardness of the roughened portions "A" of the valve plate 4 was a Vicker's hardness of 120 through 450.

Figure 8:
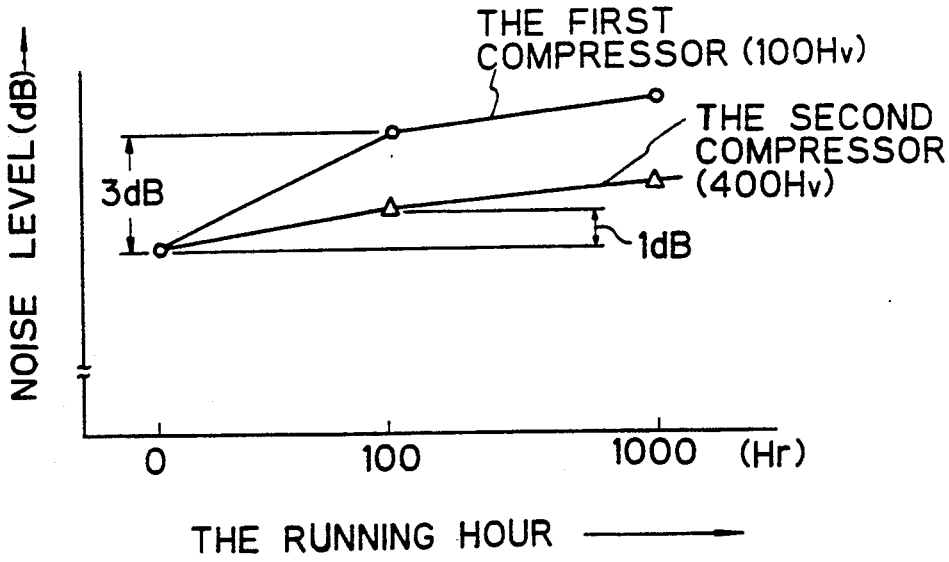
FIG. 8 is a graphical view, illustrating the relationship between the running hour of a reciprocatory piston type compressor and a change in a noise level, with the two cases wherein only surface-roughening treatment is applied to portions around discharge ports of the valve plate, and surface-roughening and surface hardening treatments are applied to portions around the discharge ports of the valve plate; and, FIG. 9 is a longitudinal cross-sectional view of a reciprocatory piston type compressor in which the discharge valve mechanism according to the prior art is accommodated but a discharge valve mechanism of the present invention may be similarly accommodated.
Figure 9:
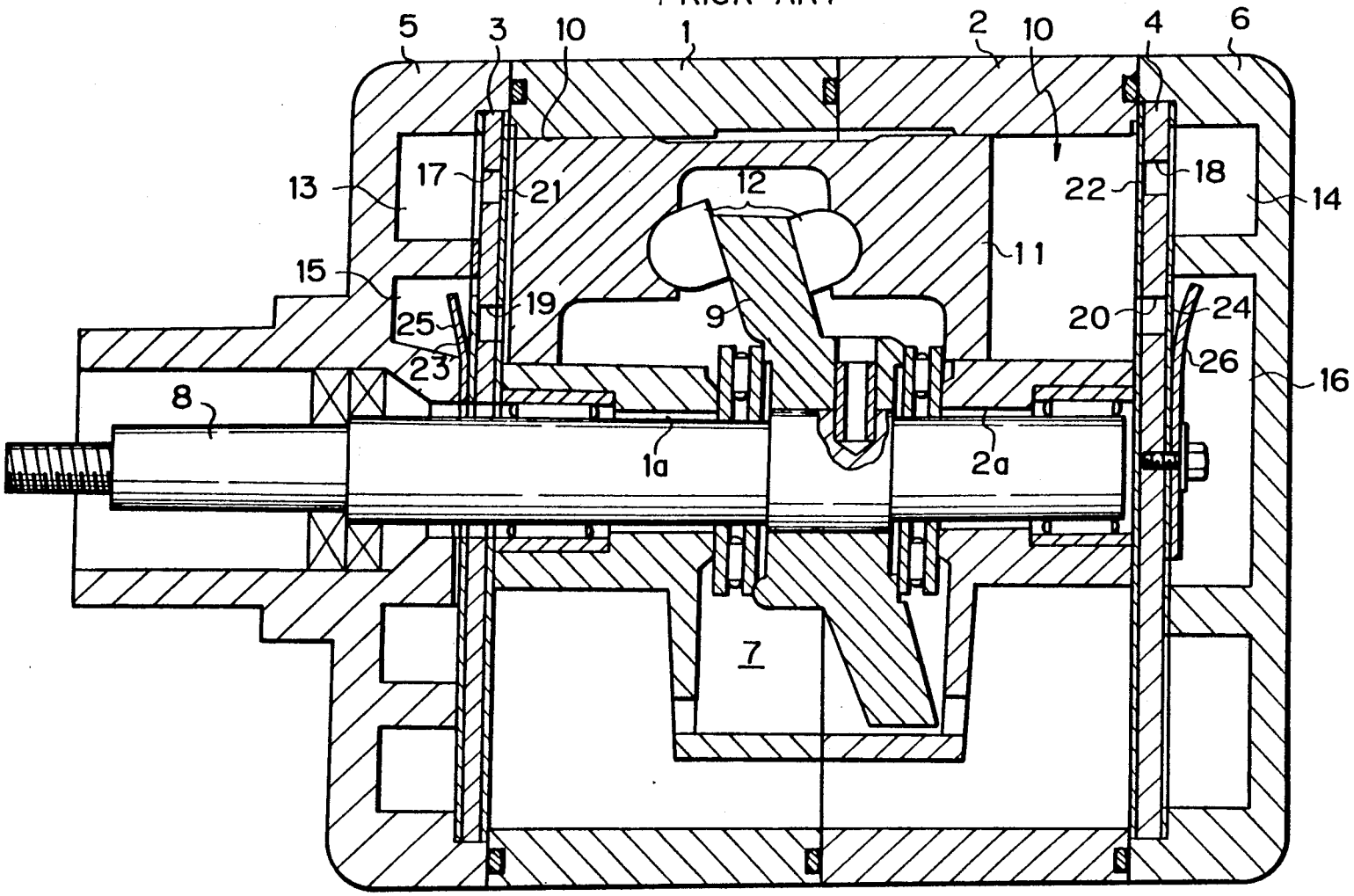
Fig. 9 PRIOR ART

FIG. 8 illustrates a result of a further experiment indicating an advantage obtained from the present invention. In the experiment of FIG. 8, a first piston type compressor accommodating therein valve plates made of hot rolled steel plate having 100 Vicker's hardness and provided with merely roughened portions "A" around the discharge ports 19 and 20, and a second piston type compressor accommodating therein valve plates provided with roughened and hardened portions "A" around the discharge ports 19 and 20 were continuously operated for 1,000 hours to measure a change in the noise level with respect to a lapse of time. The valve plates 3 and 4 of the second compressor were given a Vicker's hardness of approximately 400 by subjecting these valve plates to a hardening treatment by the quenching method.

It is understood from the graphs of FIG. 8 that the noise level of the first and second compressors was increased with a lapse of time. Particularly, from the start of the operation to 100 hours of operation, a large increase in the noise level was observed, but after 100 hours of operation, an increase in the noise level of both compressors was moderate. In FIG. 8, an increase in the noise level exhibited by the first piston type compressor using the valve plates having a Vicker's hardness of 100 was 3 dB after the continuous operation for 100 hours from the start of the operation, but that exhibited by the second piston type compressor using the valve plate having a Vicker's hardness of 400 was only 1 dB.

Furthermore, although not shown in FIG. 8, a third compressor using the valve plates made of hot rolled steel plate having a Vicker's hardness of 150 was subjected to the same experiment as those for the first and second compressors. As a result, the change in the noise level with a lapse of the operating time, as exhibited by the third compressor, was approximately the same as that exhibited by the second compressor using valve plates having a Vicker's hardness of 400. Namely, it was confirmed that, by appropriately increasing the hardness of the roughened portions of the valve plate around the discharge ports 19 and 20, a suppression of noise can be effected for a long operating time of the piston type compressor.

In the above-described various experiments, the measurement of the surface roughness ( Rz ) of the portions "A" of the valve plate 4 was performed by the surface roughness measuring machine, Model SE-3FK, manufactured and sold by Kosaka Kenkyusho in Japan, under a measuring condition such that longitudinal and lateral powers of the device were set at 1,000×20, and a measuring length was 2.5 mm.

The measurement of the surface hardness of the portions "A" of the valve plate 4 was performed by the Vicker's hardness measuring machine, manufactured and sold by Matsuzawa Seiki Co. Ltd,. in Japan, under a measuring condition such that a 10 Kg load was applied for 15 seconds. The measuring machine was mounted on a conventional workshop bench.

In the described embodiment of the present invention, it should be understood that the roughened portions "A" of the valve plates 3 and 4 may be hardened by methods other than the described quenching method and the method of adjusting the amount of carbon and manganese components of the hot rolled steel plate. For example, a surface hardening by nitriding, and the method of spraying a hard material or materials on the surface of the roughened portions may be applied.

Further, the reciprocatory piston type compressor to which the present invention is applied may be either a double-headed piston operated swash plate type compressor or a variable capacity wobble plate type compressor. In the case of the double-headed piston operated swash plate type compressor, the suction chambers may be arranged at the central portion of the front and rear housings, and the discharge chambers may be arranged at circumferential portions of the front and rear housings.

Furthermore, the described valve plate made of a single piece of iron or steel plate may be replaced with a two layer type valve plate such that a first thin iron plate member having a face coated with a resin film such as a synthetic rubber film, is fixedly attached to a face of a second valve plate member, which face confronts the discharge chamber of the compressor.

From the foregoing it will be understood that, in accordance with the present invention, the discharge valve mechanism of the reciprocatory piston type compressor is improved so that the discharge valves made generally of spring steel are always smoothly opened at an optimum timing when a pressure level in the cylinder bores rises to a desired level. Therefore, an occurrence of an excessive compression of the refrigerant gas in the cylinder bores is prevented, and accordingly, a generation of noise and vibration due to a bursting of the overcompressed refrigerant gas out of the cylinder bores is suppressed, and a pulsation of the discharge pressure from the compressor can be lowered.

We claim:

1. A reciprocatory double-headed piston type compressor comprising:

a cylinder block having a plurality of axial cylinder bores formed therein as compressing chambers for permitting therein double-headed pistons to be reciprocated to compress a refrigerant gas;

front and rear housings closing axially front and rear ends of said cylinder block for forming front and rear suction chambers receiving therein a refrigerant gas to be compressed and front and rear discharge chambers for receiving a compressed refrigerant gas;

a front valve plate arranged between said axially front end of said cylinder block and said front housing, and having a first end face confronting said axially front end of said cylinder block, an opposite second end face confronting said front housing, a plurality of suction ports for fluidly communicating between said front suction chamber of said front housing and said compression chambers of said cylinder block, and a plurality of discharge ports for fluidly communicating between said compression chambers of said cylinder block and said discharge chambers of said front housing;

a rear valve plate arranged between said axially rear end of said cylinder block and said rear housing, and having a first end face confronting said axially rear end of said cylinder block, an opposite second end face confronting said rear housing, a plurality of suction ports for fluidly communicating between said rear suction chamber of said rear housing and said compression chambers of said cylinder block, and a plurality of discharge ports for fluidly communicating between said compression chambers of said cylinder block and said discharge chambers of said rear housing;

suction valve means arranged to be in close contact with the first end face of each of said front and rear valve plates, and having a plurality of suction valves closably opening the suction ports of said front and rear valve plate in response to a reciprocating motion of said double-headed pistons; and discharge valve means arranged to be in close contact with the second face of each of said front and rear valve plates, and having a plurality of discharge valves made of spring steel and closably opening said discharge ports of said front and rear valve plates in response to a reciprocating motion of said double-headed pistons, wherein said second end face of each of said front and rear valve plates has a plurality of surface portions extended around each of said plurality of discharge ports, and formed to have a predetermined surface roughness, each of said surface portion being subjected to a hardening treatment to a Vicker's hardness of 120 through 450.

2. A reciprocatory double-headed piston type compressor according to claim 1, wherein said compressor is a swash plate type compressor.

3. A reciprocatory piston type compressor comprising:

a cylinder block having a plurality of axial cylinder bores formed therein as compressing chambers for permitting pistons therein to be reciprocated to compress a refrigerant gas;

at least a housing closing an axial end of the cylinder block for forming a suction chamber receiving therein a refrigerant gas to be compressed and a discharge chamber for receiving a compressed refrigerant gas;

a valve plate arranged between the axial end of the cylinder block and the housing, and having a first end face confronting the axial end of the cylinder block, an opposite second end face confronting the housing, a plurality of suction ports for fluidly communicating between the suction chamber of the housing and the compression chambers, and a plurality of discharge ports for fluidly communicating between the compression chambers and the discharge chambers of the housing;

a suction valve means arranged to be in close contact with the first end face of the valve plate, and having a plurality of suction valves closably opening the suction ports of the valve plate in response to a reciprocating motion of the pistons; and a discharge valve means arranged to be in close contact with the second face of the valve plate, and having a plurality of discharge valves closably opening the discharge ports of the valve plate in response to a reciprocating motion of the pistons, wherein said second end face of said valve plate has a plurality of surface portions extended around each of said plurality of discharge ports, and formed to have a predetermined surface roughness, each of said surface portions being subjected to a hardening treatment to a Vicker's hardness of 120 through 450.

4. A reciprocatory piston type compressor according to claim 3, wherein said predetermined surface roughness of said each surface portion of said second face of said valve plate is 10 through 20 Rz.

5. A reciprocatory piston type compressor according to claim 3, wherein said each surface portion of said second face of said valve plate is hardened to a Vicker's hardness of 300 through 450.

6. A reciprocatory piston type compressor according to claim 3, wherein said valve plate is made of a carbon steel, and wherein said each surface portion of said second face of said valve plate is hardened by quenching.

7. A reciprocatory piston type compressor according to claim 3, wherein said valve plate is made of a hot rolled steel having a hardness increased to said predetermined surface hardness by adjusting an amount of carbon and manganese components contained therein.

* * * * *